US006483443B1

(12) United States Patent
Lees et al.

(10) Patent No.: US 6,483,443 B1
(45) Date of Patent: Nov. 19, 2002

(54) LOOP SENSING APPARATUS FOR TRAFFIC DETECTION

(75) Inventors: Robert Harper Lees, Buckinghamshire (GB); Richard Andrew Lees, Buckinghamshire (GB)

(73) Assignee: Diamon Consulting Services Limited, Buckinghamshire (GB)

( * ) Notice: Subject to any disclaimer, the term of this patent is extended or adjusted under 35 U.S.C. 154(b) by 0 days.

(21) Appl. No.: 09/937,741

(22) PCT Filed: Mar. 30, 2000

(86) PCT No.: PCT/GB00/01221

§ 371 (c)(1),
(2), (4) Date: Jan. 3, 2002

(87) PCT Pub. No.: WO00/58927

PCT Pub. Date: Oct. 5, 2000

(30) Foreign Application Priority Data

Mar. 31, 1999 (GB) ..... 9907424

(51) Int. Cl.[7] ..... G08G 1/01

(52) U.S. Cl. ..... 340/933; 340/919; 340/928; 340/935; 340/941

(58) Field of Search ..... 340/933, 935, 340/934, 936, 938, 939, 928, 901, 905, 931, 919, 941, 916, 917, 920

(56) References Cited

U.S. PATENT DOCUMENTS

| | | | | |
|---|---|---|---|---|
| 2,525,824 A | | 10/1950 | Nagel | 235/92 |
| 3,184,730 A | | 5/1965 | Irish | 340/258 |
| 3,312,935 A | | 4/1967 | Brothman et al. | 340/941 |
| 3,651,452 A | | 3/1972 | Friedman | 340/38 L |
| 3,688,308 A | | 8/1972 | Makoto et al. | 340/941 |
| 3,697,996 A | * | 10/1972 | Elder et al. | 324/260 |
| 3,835,449 A | | 9/1974 | Viracolo | 340/933 |
| 3,983,531 A | * | 9/1976 | Corrigan | 340/936 |
| 3,984,764 A | * | 10/1976 | Koerner | 324/236 |
| 4,134,464 A | | 1/1979 | Johnson et al. | 177/3 |
| 4,430,636 A | | 2/1984 | Bruce | 340/941 |
| 4,529,982 A | | 7/1985 | Karlstrom et al. | 340/991 |
| 4,661,799 A | | 4/1987 | Buttemer | 340/941 |
| 4,945,356 A | | 7/1990 | Henderson et al. | 340/941 |
| 5,614,894 A | | 3/1997 | Stanczyk | 340/933 |
| 6,337,640 B2 | * | 1/2002 | Lees | 340/919 |

FOREIGN PATENT DOCUMENTS

| | | | |
|---|---|---|---|
| DE | 22 32 335 | | 1/1974 |
| DE | 3100724 A1 | | 7/1982 |
| DE | 3632316 A1 | | 3/1988 |
| DE | 4231881 A1 | | 3/1994 |
| EP | 0 035 960 A1 | | 3/1981 |
| FR | 1555538 | | 12/1968 |
| FR | 2254842 | | 12/1973 |
| FR | 2 549 625 A1 | | 7/1983 |
| GB | 410527 | * | 5/1934 |
| GB | 673505 | | 5/1950 |
| GB | 1245360 | | 11/1969 |
| GB | 1272534 | | 2/1970 |
| GB | 1272534 | * | 5/1972 |

* cited by examiner

*Primary Examiner*—Jeffery Hofsass
*Assistant Examiner*—Son Tang
(74) *Attorney, Agent, or Firm*—Westman, Champlin & Kelly, P.A.

(57) ABSTRACT

Loop sensing apparatus for detecting vehicles traveling along a lane of a roadway comprises an outer loop producing a region of magnetic field with the same polarity and an inner loop sized to fit within this region of constant polarity. The inner loop provides two regions of opposite polarity, so that field produced by the outer loop has a null effect on the inner loop. Detection circuitry energizes both the outer and inner loops individually for separate detection of vehicles passing over the loops.

20 Claims, 4 Drawing Sheets

60
61
62
63
64
65
66
67
68
69
70
71
72
73
74
80
81
82
83
GENERATOR & DETECTING CIRCUIT

LOOP SENSING APPARATUS FOR TRAFFIC DETECTION

This application is a national stage filing under 35 U.S.C. § 371 and priority is hereby claimed on International Application No. PCT/GB00/01221, filed Mar. 30, 2000, which International Application was published in English as No. WO 00/58927.

The present invention relates to loop sensing apparatus for traffic detection.

Such loops are well known and used commonly for monitoring traffic flow along the lanes of roadways. Typically a loop may comprise a rectangular outline loop of conductor buried just beneath the surface of the roadway and connected to energising and detecting equipment at the side of the roadway. The loop is energised with alternating current at a selected frequency to produce a corresponding alternating magnetic field in the space above the loop. Vehicles passing over the loop affect the inductance or another parameter of the loop and this can be detected by the detection equipment. Typical prior art loops comprise a single rectangular winding having a length, in the distance of travel of vehicles along the roadway, which may be a substantial proportion of the length of vehicles travelling along the roadway, say 1 meter or more, and a width transversely in the direction of travel only slightly less than the width of the roadway lane. The detection signal produced in such loops responds to the metal mass of a vehicle passing over the loop, particularly the engine and drive train, and also chassis components of longer vehicles. For detection of vehicles as a whole, loops are designed to ensure a good detection signal is achieved as the vehicle passes by. U.S. Pat. No. 3,983,531 discloses a typical inductive loop sensor roadway installation of this kind. Loops of this kind are often referred to as inductive loops and the parameter affected is usually the inductance. However other parameters could be affected, such as the Q value of a resonant circuit incorporating the loop.

There is also a requirement to count the number of axles of vehicles passing along a roadway so that multi axle vehicles for example can be distinguished from ordinary domestic automobiles for example. Accordingly, loops have been designed which are intended to be specifically sensitive to axles, or more particularly to the wheels, of vehicles passing over the loop. U.S. Pat. No. 5,614,894 discloses a wide variety of inductive loops used for the detection of the wheels of vehicles passing along the roadway. A separate loop may be used for each wheel track in each lane of the roadway and the patent indicates that the overall length of the loops in the direction of traffic movement should be relatively short, comparable to the footprint on the roadway of the vehicle wheels to be detected by the loops.

U.S. Pat. No. 5,614,894 also discloses (in FIG. 11) an arrangement comprising an axle detecting loop located within a larger size loop. The two loops are effectively connected in series from the same length of conductor. It is stated in the specification that this loop permits the determination of the length and the speed of the vehicle, though no indication is given as to how this is achieved.

The present invention provides loop sensing apparatus for detecting vehicles travelling along a lane of a roadway, the apparatus comprising an outer loop configured to provide at least one primary surface region of the roadway lane over which magnetic field produced by current in the outer loop has the same polarity, an inner loop sized to fit and located within said primary surface region, said inner loop being configured to provide a first partial surface region of the roadway lane which is within said primary surface region and over which magnetic field produced by current in said inner loop has a first polarity and a second partial surface region of the roadway lane which is within said primary surface region and over which magnetic field produced by the same current in said inner loop has second polarity opposite to said first polarity, and detection circuitry connected to permit each of said outer and inner loops to be energised individually and arranged to be responsive to respective detection signals generated in each of the loops by vehicles passing over the loops.

Using an inner loop having the configuration set out above, enables the outer and inner loops to be inductively decoupled so that separate detection signals can be obtained from each of the two loops. Because the inner loop has first and second partial surface regions providing magnetic field of opposite polarity for the same energising current in the inner loop, and these two partial surface regions are located in a primary surface region of the outer loop which has the same magnetic field polarity, it can be seen that a magnetic field produced by the outer loop should produce minimal EMF in the inner loop, and vice versa. The apparatus thus provides a more compact arrangement enabling individually independent detection signals to be obtained from the two loops.

Typically, the outer loop will be used for detecting the chassis of a vehicle as a whole, whereas the inner loop may be used for detecting a wheel or axle of the vehicle. Importantly, because such an axle loop detector provides its detection signal within the time frame of the detection signal from the main outer loop detecting the vehicle as a whole, it becomes much easier to ensure assignment of axle detections to the correct vehicle detection, thereby improving the reliability of systems intended to measure the number of axles of vehicles passing over the loop.

The inner loop may be configured to provide a central conducting segment and outer conducting segments spaced on opposite sides of said central segment whereby an electric current in the inner loop flows in a first direction along said central segment and in a second direction opposite to said first direction along each of said outer segments. Such a loop configuration is known as a figure-of-eight loop or a double D loop.

The central segment and one of the outer segments effectively enclose said first partial region and the central segment and the other of the outer segments enclose the second partial region. The outer segments of the inner loop may be symmetrically spaced on opposite sides of the central segment.

Preferably for detecting wheels and axles, the central and outer segments of the inner loop extend transversely to the traffic flow direction in the roadway lane. Again for wheel detection, the distance between the outer segments of the inner loop may be between 20 cms and 60 cms.

The first and second partial regions of the roadway lane provided by the inner loop, may have substantially the same area. However, if there is a substantial non uniformity in the field strength produced by current in the outer loop, this could be compensated for by adjusting the relative areas of the first and second partial regions of the inner loop, in order to maintain minimal inductive coupling between the two loops.

Preferably the outer loop has a leading edge and a trailing edge relative to the traffic flow direction in the roadway lane and the inner loop is located asymmetrically relative to a median line substantially halfway between the leading and trailing edges of the outer loop. Then, the relative timing of the detection signals from the inner and outer loops can provide an indication of the direction of travel of a vehicle over the loop. Conveniently, the inner loop can be located nearer to the leading edge of the outer loop.

The apparatus may include a second outer loop of the same form as the first mentioned outer loop and located, relative to the first outer loop, upstream in the traffic flow direction along the roadway lane, the detection circuitry then further permitting the second outer loop to be individually energised and being responsive also to detection signals generated in the second outer loop by vehicles passing over the second outer loop. Such an arrangement not only allows the direction of a vehicle over the loops to be confirmed, but also permits the correct detection of vehicles entering the detection zone in the normal traffic flow direction, coming to a stop on the loops, and then reversing back off the loops. It is especially useful to be able to detect such a manoeuvre when detection loops of this kind are used for example at the entry of a toll lane. Previous arrangements have had considerable difficulty in detecting when a vehicle entering the lane does not proceed onwards but instead reverses backwards off the detection zone.

The apparatus may also include an additional inner loop of the same form as the first mentioned inner loop and located within a said primary surface region of the outer loop at a position downstream in the traffic flow direction relative to the first inner loop, the detection circuitry then further permitting said additional inner loop to be individually energised and being responsive also to detection signals generated in the additional inner loop by vehicles passing over the additional inner loop. Such an arrangement enables a composite loop structure within the confines of a single outer loop, to be used for detecting vehicle direction, vehicle speed and also vehicle length.

A pair of the inner loops may be located side-by-side across the width of the outer loop at the same position in the traffic flow direction, each of the pair of inner loops being located within a said primary surface region, the detection circuitry then further permitting each of the inner loops to be individually energised and being responsive also to respective detection signals generated in each of the inner loops by vehicles passing over the loops. Such an arrangement enables a response to be obtained from each of the wheels on a single axle of a vehicle.

In one arrangement, the outer loop has the same form as the inner loop, being configured to provide first and second partial surface regions corresponding to the partial surface regions of the inner loop, the inner loop then being sized to fit and located within one of the first and second partial surface regions of the outer loop. Usually the central and outer segments of the outer loop are arranged to extend transverse to the traffic flow direction. Then the outer loop can be for axle/wheel detection and the inner loop enables the direction of travel across the axle detector to be identified.

Examples of the invention will now be described with reference to the accompanying drawings in which.

Figure 1:
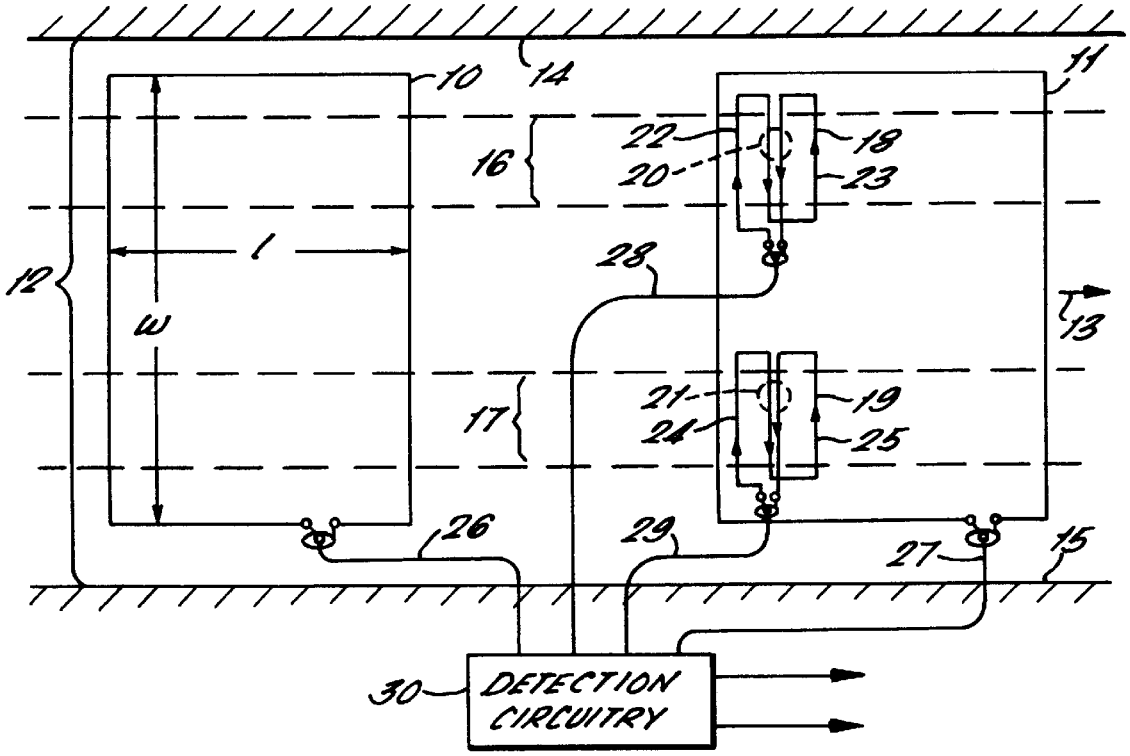
FIG. 1 is a schematic plan view of a vehicle detection station along a lane of a roadway.

In FIG. 1, the position is illustrated of two successive outer loop sensors 10 and 11 along a lane 12 of a roadway. Normal direction of travel of vehicles along the lane is illustrated by the arrow 13. The lane 12 of the roadway is shown between lateral boundaries 14 and 15. It should be understood that these boundaries 14 and 15 need not be physical boundaries, but merely the demarcations of the lane on a wider roadway.

The lane is essentially wide enough to accommodate normal traffic vehicles including large goods vehicles and trucks. The normal rolling tracks of the wheels of vehicles travelling along the lane 12 are illustrated at 16 and 17 between pairs of parallel dotted lines in the drawing.

Loop sensors 10 and 11 in FIG. 1 are each formed as a single substantially rectangular loop having a width w which extends over a substantial proportion of the overall width of the roadway lane 12, and a length 1 in the direction of traffic flow 13 which is a significant proportion of the length of typical road vehicles travelling on the roadway. For example, the loops 10 and 11 may have a length 1 of 2 meters and a width w of 2 to 3 meters. In the present embodiment, it is important, as will become apparent, that at least the loop 11 has a width w sufficient to extend completely over both wheel rolling tracks 16 and 17 of the lane 12, so that the width may in fact typically be about 3 meters or slightly more, to ensure that normal heavy goods vehicles are fully accommodated.

Each of the outer loops 10 and 11 is formed of at least one complete turn of conductor. Typically, each of the loops is formed of three turns. For simplicity, only a single turn is illustrated in the drawings.

The conductors forming the loops 10 and 11 are buried a short distance below the running surface of the roadway lane 12 in accordance with normal practice for inductive detection loops of this kind.

It will be appreciated that a current flowing around either of the loops 10 or 11 will produce a magnetic field throughout the surface region of the roadway enclosed by the respective loop which extends in a direction substantially normal to the road surface. More particularly, for an alternating current flowing in the conductors of either of loops 10 or 11, the magnetic field over the entire surface region enclosed by the respective loop will have the same polarity, in the sense that the magnetic field everywhere enclosed by the loop will be directed out of the surface of the road during one half cycle of the alternating current, and will be directed into the surface of the road during the other half cycle of the current.

In the embodiment of FIG. 1, two further inductive loops 18 and 19 are shown located wholly within the surface region enclosed by the loop 11. The two further loops 18 and 19 are substantially identical and each comprises a figure-of-eight conductive loop having a transversely extending central conducting segment 20, 21 and outer conducting segments 22, 23:24, 25. Because of the figure-of-eight construction of each of the loops 18 and 19, it can be seen that a current in the loop flows in the central segment 20, 21 of each loop transversely across the roadway in a first direction, and flows in the outer segments 22, 23:24, 25 transversely in the opposite direction.

Each of the loops 18 and 19 extends transversely across a respective one of the wheel running tracks 16 and 17 of the roadway lane 12. The two loops are substantially aligned so as to be in the same position along the roadway in the direction of travel 13. Each of the loops 20 and 21 is wide enough, transverse to the direction of travel, so as to fully straddle its respective wheel running track 16 and 17. The typical width of each of the loops 18 and 19 is about 120 cms. The loops have a length, in the direction of travel, which is preferably less than about 60 cms and is typically about 45 cms.

As with the outer loops 10 and 11, the inner loops 18 and 19 are formed by burying appropriate conductors a small distance below the roadway surface. Each of the loops is formed symmetrically on either side of its respective central segment 20, and 21, so that the two halves of the loop are substantially the same area. The effect of the construction illustrated is to confine the magnetic field produced by energising currents flowing in the loop to a height above the roadway of not significantly more than about 22 cms.

Figure 4:
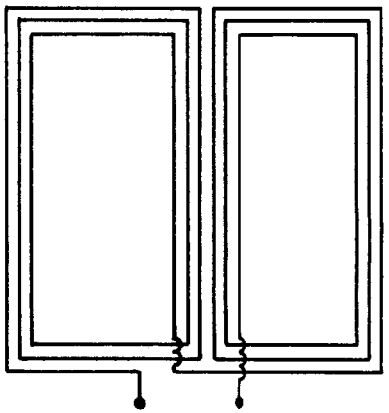
FIG. 4 is a schematic plan view of a different configuration of loop for use with various embodiments of the invention.

In the drawing, each of the loops 18 and 19 is illustrated as a single figure-of-eight winding of conductor. It will be understood that the loops may be formed of multiple windings repeatedly following the track of the single winding illustrated. In a different embodiment the loops 18 and 19 may be configured as separate multiple turn windings of opposite hand connected in series. Such an arrangement is illustrated in FIG. 4, which shows a pair of two turn windings connected in series to provide the same electrical effect as a repeated figure-of-eight loop. Typical loops may comprise three turns in each winding.

Outer loops 10 and 11 as well as inner loops 18 and 19 are connected via respective connecting cables 26, 27, 28 and 29 to detection circuitry 30 which may be mounted at the side of the roadway. The connecting cables 26 to 29 are also buried beneath the roadway surface. In the Figure, the connecting cables are shown by single lines for simplicity, but it will be understood that each connection cable must be in the form of a dual conductor and may be a co-axial conductor for example.

The detection circuitry 30 includes a generator for supplying an alternating current signal to each of the loops 10, 11, 18 and 19, via the connecting cables 26 to 29. As a vehicle passes over the outer loop 10, the inductance of the loop 10 will be changed by the effect of the metal mass of a vehicle, particularly the engine, drive train and large chassis components. The outer loop 11 responds to vehicles passing over the loop in a similar fashion to loop 10. However, the inner loops 18 and 19 are adapted to respond primarily to the tires and wheels of vehicles travelling along the wheel tracks 16 and 17 in the lane 12. In each case, the change in inductance of the respective loop is sensed at the detection circuitry 30 as a change in amplitude (or frequency) of the energising signal supplied to the respective loop.

Importantly, the figure-of-eight construction of the inner loops 18 and 19 make these loops very poorly inductively coupled with the outer loop 11. If the magnetic field produced by a current in the outer loop 11 is substantially homogeneous over each of the regions occupied by the inner loops 18 and 19, and the areas enclosed by each half of the figure-of-eight of each of the loops 18 and 19 are substantially equal, the EMF induced in each of the inner loops 18 and 19 by the magnetic field of the outer loop will be substantially zero.

It can be seen that each of the inner loops 18 and 19 is in fact configured to provide a first partial surface region of the roadway (i.e. the region enclosed between the central segment 20 and the left hand outer segment 22 of the loop 18) over which magnetic field produced by a current in the inner loop has a first polarity, and a second partial surface region of the roadway (i.e. between the central segment 20 and the right hand outer segment 23) over which magnetic field produced by this current in the inner loop has a second polarity opposite to the first polarity.

It is important to minimise inductive coupling between the inner loops 18 and 19 and the outer loop 11, to minimise the amount of "cross talk" between inner and outer loops in the event that all loops are energised simultaneously. In this way, signals representative of the passage of wheels and axles over the inner loops 18 and 19 can be detected independently of the signal from the outer loop 11 corresponding to the larger metal components of a vehicle.

In practical embodiments, the detection circuitry may in fact be arranged to "scan" through the various loops of the installation, applying an energising signal to the respective loops in sequence and obtaining a corresponding response signal. The detection circuitry 30 is arranged to scan the loops repeatedly at a sufficient rate to ensure that substantially continuous monitoring of the passage of vehicles by each loop is possible up to the maximum vehicle speeds expected. Scan rates for the loops may be above 100 Hz and typically as high as 2 kHz. The frequency of the alternating current signal used to energise the loops may be in excess of 10 kHz or even above 100 kHz.

Even when a scanning system is used to energise each of the loops, including the inner and outer loops illustrated in FIG. 1, in sequence, it is still necessary to ensure minimal inductive coupling between the inner and outer loops. This is because the scanning system usually applies a short circuit to a loop which is not currently energised. Thus the short circuited loop or loops would severely reduce, if not eliminate, any magnetic field produced by another energised loop which was inductively coupled to the shorted loop.

It can be seen, therefore, that the arrangement shown in FIG. 1 permits the general chassis of vehicles to be detected by the outer loop 11, as well as by the preceding outer loop 10, whilst the axles/wheels of the vehicle are separately detected by the inner loops 18 and 19.

Because the inner loops 18 and 19 are wholly within one of the outer loops 11, axle detection signals from the inner loops 18 and 19 will have a very definite time correlation with the chassis detection signal from the outer loop 11. This allows axle signals to be correlated with the vehicle detection signal more easily, reducing the possibility of assigning axle detections to the wrong vehicle.

Although the embodiment illustrated in FIG. 1 has two outer loops 10 and 11, some examples of the invention may use only a single outer loop. A second outer loop 10 as illustrated is useful in obtaining more accurate speed and length measurements of vehicles passing over the detection station.

In the arrangement illustrated in FIG. 1, it will be noted that the inner loops 18 and 19 are located asymmetrically relative to a notional median line dividing the outer loop 11 into leading and trailing halves. This asymmetric location of the loops 18 and 19 in the outer loop 11 can enable the combination of signals from the inner and outer loops to provide more information on the direction of motion of a vehicle which may have come to rest over one of the loops.

Figure 5:
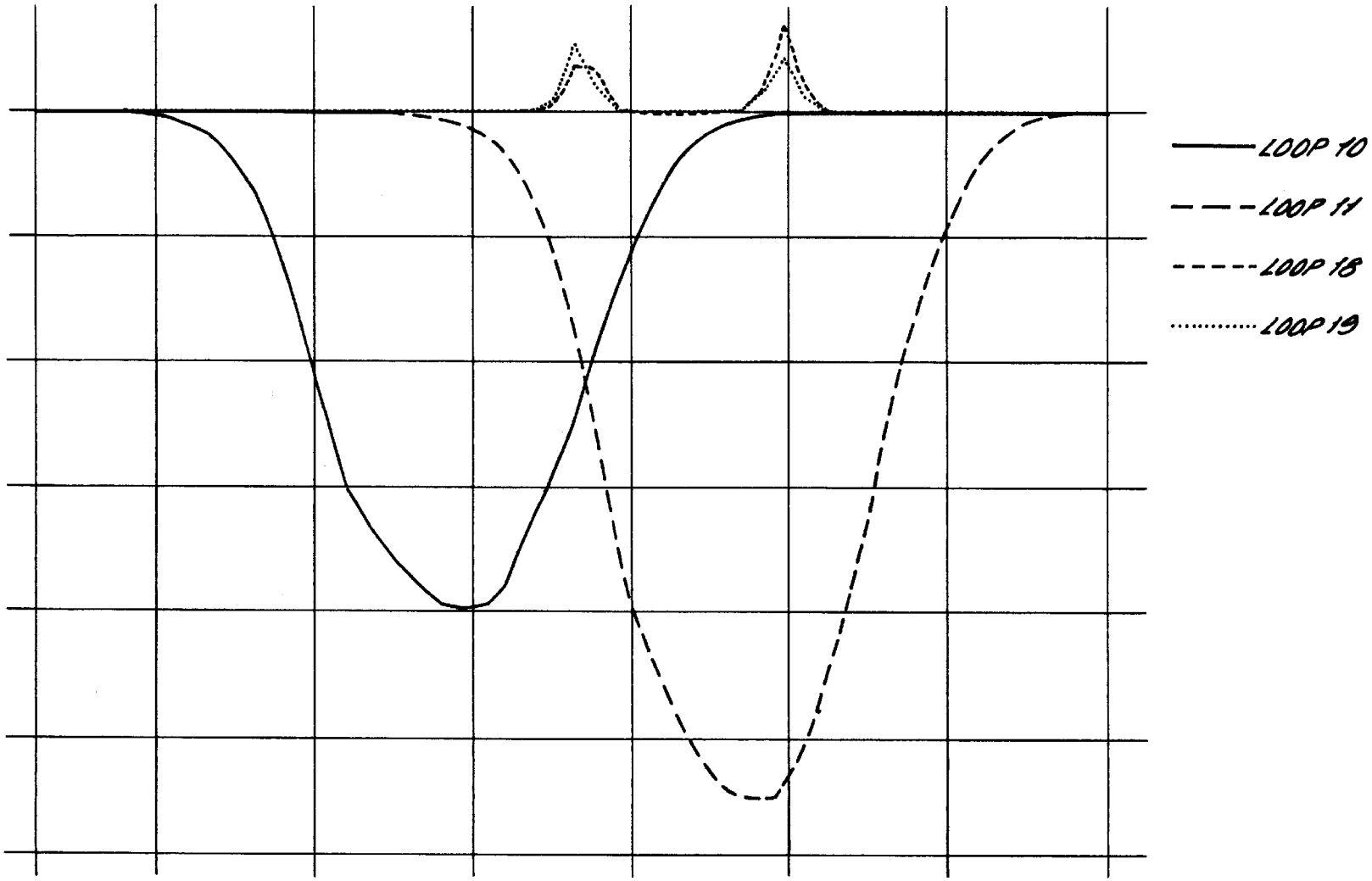
FIGS. 5 and 6 are graphical representations of the detection signals from the loops of the embodiment of the invention illustrated in FIG. 1.
Figure 6:
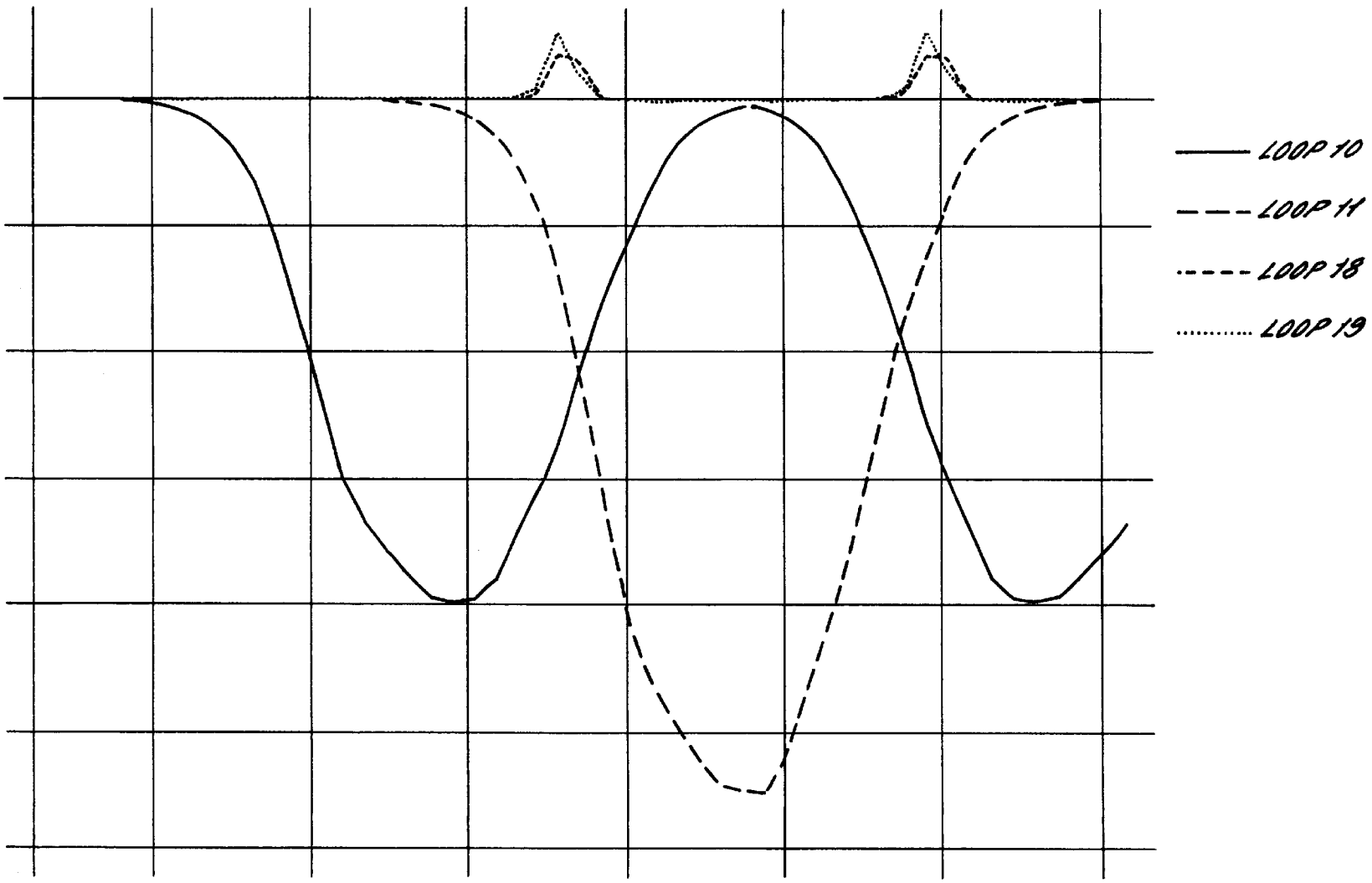

FIG. 5 illustrates the detection signals which may be obtained from each of the outer loops 10 and 11 and the inner loops 18 and 19, for a vehicle with two axles passing in direction 13 over the detection station. The signals from the axle detecting loops 18 and 19 are well associated with the signal from the outer loop 11 responding to the chassis of the vehicle. By comparison, FIG. 6 illustrates the detection signals from the loops which might arise for a vehicle which comes to a stop over loop 11, with its front axle only having crossed the inner loops 18 and 19, and then reverses back out of the detection station. The timing of the detection signals from the axle detecting loops 18 and 19, relative to the detection signal from the outer loop 11 is quite different from the FIG. 5 example, and this distinction can be used to more accurately detect a vehicle which has reversed away from the detection station. This can be especially useful in avoiding false vehicle counts at automatic tolling lanes for example.

Figure 2:
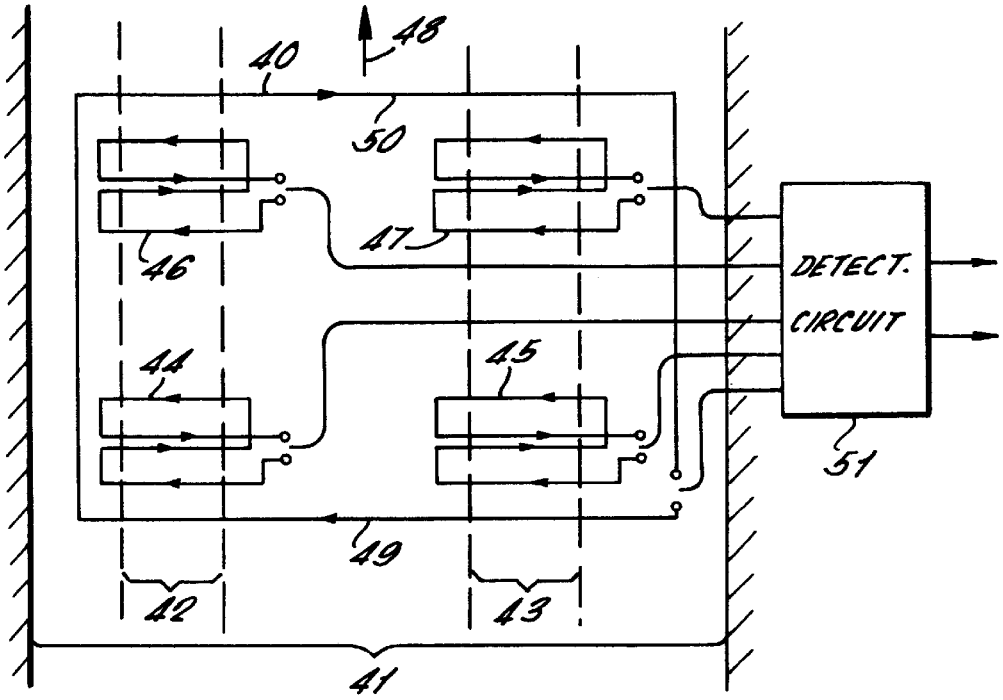
FIG. 2 is a schematic plan view of a second embodiment of road detection station.

FIG. 2 illustrates a further example of the invention which enables most vehicle measurements to be obtained without the need for a second main vehicle detection loop. In FIG. 10, a single outer loop 40 extends over substantially the entire width of the roadway lane 41 and in particular extends over both wheel rolling tracks 42 and 43 in the lane. Inside the outer loop 40 there are four inner loops 44, 45, 46 and 47. The inner loops 44 to 46 have the same construction as the inner loops 18 and 19 of FIG. 11 and as can be seen, loops 44 and 45 are aligned across the lane of the roadway to have the same distance in the direction of travel, illustrated in this Figure by the arrow 48. Loops 44 and 45 are adjacent a leading edge 49 of the outer loop 40. Loops 46 and 47 are also aligned across the roadway adjacent the trailing edge 50 of the outer loop 40. The inner loops 44 to 47 straddle the respective rolling tracks 42 and 43 as illustrated. All the loops are connected by respective cables to detection circuitry 51.

As before, the outer loop 40 is responsive to the main metal parts of a vehicle crossing the detection station, whereas each of the loops 44 to 47 are responsive only to the wheels, wheel hubs and tires of the vehicles. Each of the loops 44 to 47 is arranged to have minimal inductive coupling with the outer loop 40.

With this arrangement, a very compact detection station is provided all within the area of a single loop which may have a typical length in the traffic flow direction of about 2 meters. Speed of vehicles traversing the station can be detected quite accurately from the time between a particular axle of a vehicle being detected firstly by the loops 44 and 45 and then by the loops 46 and 47. The length of a vehicle can also then be determined, using the above measured speed, from the timing of the first entry and last exit of the body of a vehicle over the main loop 40. Direction of traffic flow can also easily be measured using the timing of axle activations in the loops 44 and 45 compared with those in the loops 46 and 47. Stopping and reversing on the loop can also be detected in a manner similar to that described with reference to FIG. 1. The arrangement may also be used for detecting tailgating by comparing the relationship between axle detections by the inner loops and the overall vehicle body effect of the outer loop 40.

As with the FIG. 1 arrangement, because each of the axle detection loops is located wholly within the main vehicle detection loop 40, proper correlation of axle detections with a vehicle detection is more reliable.

Figure 3:
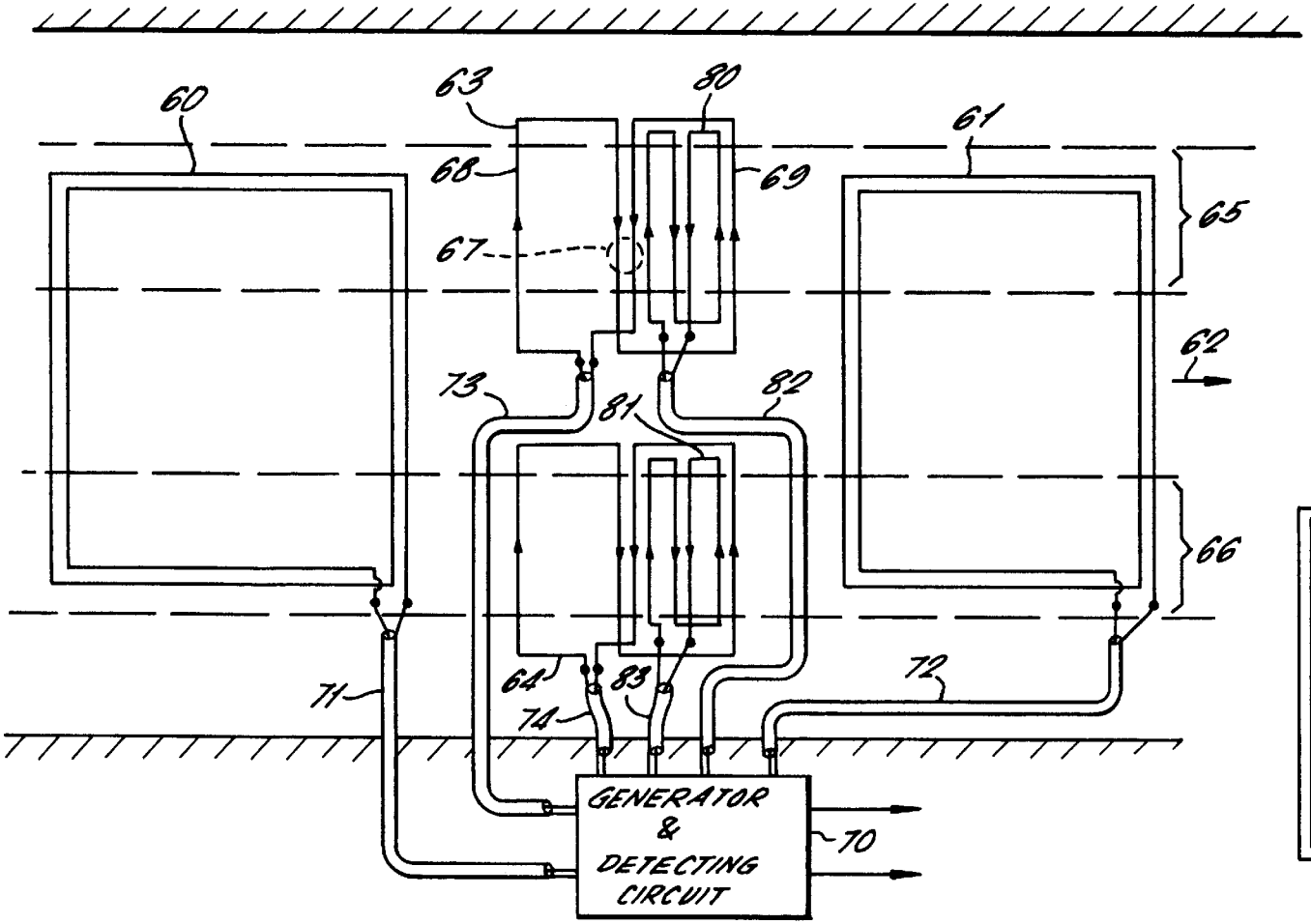
FIG. 3 is a schematic plan view of a third: embodiment of road detection station.

FIG. 3 illustrates a further embodiment of the invention comprising main vehicle detection loops 60, 61 spaced along a roadway lane in a direction of traffic flow 62. Each of the loops 60 and 61 should be sufficient wide across the width of the roadway lane to ensure activation by the main body and chassis of a vehicle travelling along the lane. The main loops 60 and 61 may have a width across the lane of about 2 to 3 meters and each have a length in the direction of travel of about 2 meters. The two loops 60 and 70 are separated by about 2 meters. In the space between the two loops 60 and 70 are located a pair of figure-of-eight type wheel/axle detecting loops 63, 64. The axle detection loops 63 and 64 are aligned at the same position in the direction of travel along the roadway lane and respectively straddle the two wheel rolling tracks 65, 66 of the lane. Each of the axle/wheel detection loops 63 and 64 is formed as a figure-of-eight winding having a central segment 67 and outer segments 68 and 69, in the same manner as the inner loops 18 and 19 of FIG. 1. Each of the main loops 60, 61 and the wheel/axle detection loops 63, 64 is connected to a generator and detecting circuit 70 at the roadside by means of respective cables 71, 72, 73, 74.

Each of the axle loops 63, 64 may have a length in the direction of travel between the two outer segments 68 and 69 of a respective loop of 60 cms or less, preferably about 45 cms. The width of each of the loops 63, 64 across the roadway lane is sufficient to straddle the respective wheel rolling track of the lane and is typically about 120 cms.

As illustrated in FIG. 3, a further figure-of-eight type winding 80, 81 is located in the right hand half (as illustrated) of each of the wheel/axle detecting loops 63 and 64. Thus, figure-of-eight winding 80 is located between the central segment 67 and the trailing outer segment 69 of the loop 63, and figure-of-eight loop 81 is located between the corresponding segments of the loop 64. In this region of each of the loops 63 and 64, the magnetic field produced by current in the respective loop has the same polarity. Thus, the magnetic field throughout the region enclosed by loop 63 between the central segment 67 and the outer segment 69 has the same polarity, opposite to that in the region between the central segment 67 and the leading outer segment 68 of the loop. As a result, there is minimal inductive coupling between the figure-of-eight loop 80 and the loop 63.

The figure-of-eight loop 80, 81 in each of the wheel/axle detection loop 63, 64, is also arranged to extend substantially the full width of the respective loops 63 and 64, thereby straddling the respective wheel rolling track 65 and 66. The overall distance between the respective outer segments of the loops 80 and 81 will be about half the distance between the outer segments of the loops 63 and 64. Thus, where the overall length of the loops 63 and 64 may be about 45 cms, then the overall length of the loops 80 and 81 will be about 22 cms. However, this length will still be sufficient generally to enable the loops 80 and 81 to obtain a response signal from a wheel, wheel hub or tire passing over the loops.

Because the internal figure-of-eight windings 80 and 81 are asymmetrically positioned relative to the centre line of the wheel/axle detection loops 63 and 64, the relative timing between the response signals from the loops 63 and 80, for the same wheel passing over the loop, will provide an indication of the direction of travel of the wheel. Similarly, the relative timing of the response signals from the loops 64 and 81 will also provide an indication of the direction of travel. This construction, therefore, provides a more compact arrangement for detecting the possibility of vehicles reversing off a detection station, in circumstances where this will be difficult to detect using only the main loops 60 and 61 and single axle loops 63 and 64 without further internal loops 80 and 81.

As illustrated, the internal loops 80 and 81 are connected by respective cables 82 and 83 also to the generator and detecting circuits 70. It should be understood that the internal loops 80 and 81 may take any of the construction forms contemplated for the inner loops illustrated with respect to FIGS. 1 and 2, or indeed for the axle/wheel detection loops 63 and 64 in FIG. 3. In particular these loops may be formed as multiple figure-of-eight turns, or as multi turn coils of opposite polarity connected in series (as illustrated in FIG. 4).

Although three specific embodiments of the invention have been described above, other embodiments may also be contemplated. The essential feature of the invention is that a vehicle detection station has an outer loop with an inner loop arranged inside the outer loop so as to provide minimal mutual inductance between the two. The outer loop may be a simple, multi turn vehicle detection loop as illustrated in FIGS. 1 and 2, or may itself be a more complex loop shape as illustrated in FIG. 3.

In the embodiments of FIGS. 1 and 2, the inner loops each extend over only one wheel rolling track of a roadway lane, so that each wheel assembly on a common axle can be separately detected. In other embodiments the inner loop or loops may extend substantially the full width of the lane so as to cover both rolling tracks. Then both wheel assemblies on a common axle would be detected together as a single detection signal.

What is claimed is:

1. Loop sensing apparatus for detecting vehicles travelling along a lane of a roadway, the apparatus comprising an outer loop configured to provide at least one primary surface region of the roadway lane over which magnetic field produced by current in the outer loop has the sane polarity, an inner loop sized to fit and located within said primary surface region, said inner loop being configured to provide a first partial surface region of the roadway lane which is within said primary surface region and over which magnetic field produced by a current in said inner loop has a first polarity and a second partial surface region of the roadway lane which is within said primary surface region and over which magnetic field produced by the same current in said inner loop has a second polarity opposite to said first polarity, and detection circuitry connected to permit each of said outer and inner loops to be energised individually and arranged to be responsive to respective detection signals generated in each of the loops by vehicles passing over the loops.

2. Loop sensing apparatus as claimed in claim 1, wherein said inner loop is configured to provide a central conducting segment and outer conducting segments spaced on opposite sides of said central segment whereby an electric current in the inner loop flows in a first direction along said central segment and in a second direction opposite to said first direction along each of said outer segments.

3. Loop sensing apparatus as claimed in claim 2, wherein the central segment and one said outer segment enclose said first partial region and the central segment and the other said outer segment enclose said second partial region.

4. Loop sensing apparatus as claimed in claim 2, wherein the outer segments of said inner loop are symmetrically spaced on opposite sides of said central segment.

5. Loop sensing apparatus as claimed in claim 2, wherein said central and outer segments of said inner loop extend transversely to the traffic flow direction in said roadway lane.

6. Loop sensing apparatus as claimed in claim 5, wherein the distance between the outer segments of said inner loop is between 20 cms and 60 cms.

7. Loop sensing apparatus as claimed in claim 1, wherein said first and second partial regions of the roadway lane have substantially the same area.

8. Loop sensing apparatus as claimed in claim 1, wherein said outer loop has a leading edge and a trailing edge relative to the traffic flow direction in the roadway lane and said inner loop is located asymmetrically relative to a median line substantially halfway between said leading and trailing edges of the outer loop.

9. Loop sensing apparatus as claimed in claim 8, wherein said inner loop is located nearer to the leading edge of the outer loop.

10. Loop sensing apparatus as claimed in claim 9, and further including a second outer loop of the same form as said first mentioned outer loop and located, relative to said first outer loop, upstream in the traffic flow direction along said roadway lane, said detection circuitry further permitting said second outer loop to be individually energised and being responsive also to detection signals generated in said second outer loop by vehicles passing over said second outer loop.

11. Loop sensing apparatus as claimed in claim 9, and further including an additional inner loop of the same form as said first mentioned inner loop and located within a said primary surface region of said outer loop at a position downstream in the traffic flow direction relative to said first inner loop, said detection circuitry further permitting said additional inner loop to be individually energised and being responsive also to detection signals generated in said additional inner loop by vehicles passing over said additional inner loop.

12. Loop sensing apparatus as claimed in claim 8 as dependent on claim 8, wherein said detection circuitry is responsive to the relative timing of detection signals in said inner and outer loops to provide an indication of the direction of travel of a vehicle over the loops.

13. Loop sensing apparatus as claimed in claim 1, wherein said inner loop has a width across the traffic flow direction which is less than half the width of said outer loop.

14. Loop sensing apparatus as claimed in claim 13, and including a pair of said inner loops located side-by-side across the width of said outer loop at the same position in the traffic flow direction, each of said pair of inner loops being located within a said primary surface region, said detection circuitry further permitting each of said inner loops to be individually energised and being responsive also to respective detection signals generated in each of said inner loops by vehicles passing over the loops.

15. Loop sensing apparatus as claimed in claim 1, wherein said outer loop has the same form as said inner loop, being configured to provide first and second partial surface regions corresponding to said partial surface regions of said inner loop, said inner loop being sized to fit and located within one of said first and second partial surface regions of said outer loop.

16. Loop sensing apparatus as claimed in claim 15, wherein said outer loop is configured to provide a central conducting segment and outer conducting segments spaced on opposite sides of said central segment whereby an electric current in the outer loop flows in a first direction along said central segment and in a second direction opposite to said first direction along each of said outer segments.

17. Loop sensing apparatus as claimed in claim 16, wherein said central and outer segments of said outer loop extend transverse to the traffic flow direction in said roadway lane.

18. Loop sensing apparatus as claimed in claim 17, wherein the distance between the outer segments of said outer loop is not great than 60 cms.

19. Loop sensing apparatus as claimed in claim 17, wherein the width of the outer loop transverse to the traffic flow direction is not greater than 140 cms.

20. Loop sensing apparatus as claimed in claim 19, and including a pair of said outer loops located side-by-side across the width of the roadway lane transverse to the traffic flow direction, said detection circuitry further permitting each of said outer loops to be individually energised and being responsive also to respective detection signals generated in each of said outer loops by vehicles passing over the loops.

* * * * *